US007194220B2

(12) United States Patent
Sasaki et al.

(10) Patent No.: US 7,194,220 B2
(45) Date of Patent: Mar. 20, 2007

(54) PROCESS CARTRIDGE HAVING CARTRIDGE ELECTRICAL CONTACT CONNECTED TO A CARTRIDGE MEMORY ELEMENT AND CONNECTABLE TO A MAIN ASSEMBLY ELECTRICAL CONTACT AND IMAGE FORMING APPARATUS TO WHICH SUCH CARTRIDGE IS MOUNTABLE

(75) Inventors: Teruhiko Sasaki, Mishima (JP); Miho Kaiga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 11/048,755

(22) Filed: Feb. 3, 2005

(65) Prior Publication Data

US 2006/0062589 A1 Mar. 23, 2006

(30) Foreign Application Priority Data

Sep. 17, 2004 (JP) ..... 2004-272029
Feb. 1, 2005 (JP) ..... 2005-025000

(51) Int. Cl.
*G03G 15/00* (2006.01)
*G03G 21/16* (2006.01)

(52) U.S. Cl. ..... 399/90; 399/111

(58) Field of Classification Search ..... 399/90, 399/110, 111
See application file for complete search history.

(56) References Cited

U.S. PATENT DOCUMENTS 5,920,753 A 7/1999 Sasaki et al. ..... 399/111
5,926,666 A * 7/1999 Miura et al. ..... 399/90 X
6,011,941 A 1/2000 Takashima et al. ..... 399/111
6,137,971 A 10/2000 Sasaki et al. ..... 399/106
6,137,973 A 10/2000 Nishiuwatoko et al. ..... 399/111
6,141,508 A 10/2000 Sasaki et al. ..... 399/27
6,178,302 B1 1/2001 Nagashima et al. ..... 399/106
6,183,075 B1 2/2001 Sasaki ..... 347/86
6,327,448 B1 12/2001 Sasaki ..... 399/111
6,404,995 B1 * 6/2002 Kimizuka ..... 399/111 X
6,556,792 B2 * 4/2003 Yoshimura ..... 399/111 X
6,714,749 B2 3/2004 Sato et al. ..... 399/102

(Continued)

FOREIGN PATENT DOCUMENTS

JP 2003-177650 A 6/2003

*Primary Examiner*—Sandra L. Brase
(74) *Attorney, Agent, or Firm*—Fitzpatrick, Cella, Harper & Scinto

(57) ABSTRACT

A process cartridge detachably mountable to a main assembly of an electrophotographic image forming apparatus. The main assembly includes an opening, a cover movable between open and closed positions, and a main assembly electrical contact. The cartridge includes a photosensitive drum; a memory element for storing cartridge; a cartridge contact electrically connected with the memory element being electrically connectable to the main assembly contact when the cover is moved from the open to the closed position after cartridge mounting; a first engaging portion for engaging a main assembly supporting member to position the supporting member with respect to a longitudinal direction of the cartridge before the cover is moved from the open position, and a second engaging portion for engaging the supporting member which moves in interrelation with a movement of the cover when the cover is moved from the open toward the closed position after cartridge mounting and for positioning the supporting member in a direction crossing the longitudinal direction before the main assembly contact is electrically connected with the cartridge contact.

12 Claims, 12 Drawing Sheets

U.S. PATENT DOCUMENTS

| | | | | |
|---|---|---|---|---|
| 6,901,229 | B2 | 5/2005 | Nishiuwatoko et al. | 399/167 |
| 2002/0025185 | A1* | 2/2002 | Ito et al. | 399/111 |
| 2003/0091361 | A1 | 5/2003 | Noda et al. | 399/90 |
| 2003/0123896 | A1* | 7/2003 | Goto et al. | 399/90 |
| 2003/0215257 | A1* | 11/2003 | Karakama et al. | 399/90 |
| 2003/0215561 | A1* | 11/2003 | Karakama et al. | 399/111 |

* cited by examiner

PROCESS CARTRIDGE HAVING CARTRIDGE ELECTRICAL CONTACT CONNECTED TO A CARTRIDGE MEMORY ELEMENT AND CONNECTABLE TO A MAIN ASSEMBLY ELECTRICAL CONTACT AND IMAGE FORMING APPARATUS TO WHICH SUCH CARTRIDGE IS MOUNTABLE

FIELD OF THE INVENTION AND RELATED ART

The present invention relates to an electrophotographic image forming apparatus in which a process cartridge is removably mountable, and a process cartridge removably mountable in an electrophotographic image forming apparatus.

Here, an electrophotographic image forming apparatus (which hereafter will be referred to as an image forming apparatus) is an apparatus which forms an image on a recording medium with the use of one of the electrophotographic image forming methods. As for examples of an image forming apparatus, there are an electrophotographic copying machine, an electrophotographic printer (for example, a laser printer, an LED printer, etc.) a facsimile machine, a word processor, and a multifunction printer capable of performing the functions of two or more of the preceding apparatuses.

A process cartridge is a cartridge in which at least one processing means among a charging means, a developing means, and a cleaning means, and an electrophotographic photosensitive drum, are integrally disposed, and which is removably mountable in the main assembly of an image forming apparatus. In other words, it includes a cartridge in which at least a developing means as a processing means, and an electrophotographic photosensitive drum are integrally disposed, and which is removably mountable in the main assembly of an image forming apparatus. Incidentally, a processing means connotes a means for performing a process on an electrophotographic photosensitive member, and includes the above-mentioned charging means, developing means, and cleaning means.

In the field of an image forming apparatus which employs an electrophotographic image formation process, it has been a common practice to use a process cartridge system in which a process cartridge is removably mountable in the main assembly of an image forming apparatus. The process cartridge system makes it possible for a user himself to maintain an image forming apparatus, without relying on a service person, drastically improving an image forming apparatus in operability. Thus, the process cartridge system is widely in use in the field of an image forming apparatus.

In order to obtain a satisfactory image with the use of an image forming apparatus which employs a process cartridge (which hereinafter will be referred to simply as a cartridge) such as the above-described one, a cartridge must be precisely mounted in a predetermined cartridge position in the image forming apparatus, and the interfacing portions, such as various electrical contacts, driving force transmitting portions, etc., on the cartridge side must be correctly connected to those on the main assembly side of an image forming apparatus.

Some image forming apparatuses have been known for the structural arrangement that in order to correctly connect the electrical contacts on the main assembly side of an image forming apparatus to those on the cartridge side, the direction in which the electrical contacts on the main assembly side are aligned is virtually the same as the direction in which a cartridge is mounted into the image forming apparatus (U.S. Pat. No. 6,011,941).

Further, some image forming apparatuses have been known for the structural arrangement that movable guides are disposed in the main assembly of an image forming apparatus, and are connected to the hinged cover of the main assembly so that the movable guides are moved by the opening or closing movement of the hinged cover (Japanese Laid-open Patent Application 2003-177650). With the provision of this structural arrangement, as the hinged cover is opened or closed, the cartridge is conveyed to the cartridge compartment in the main assembly, following the predetermined track, and is precisely positioned in the cartridge compartment. Therefore, the electrical contacts on the cartridge side are correctly connected to those on the main assembly side.

The present invention is one of further developments of the above-described prior art for correctly connecting the electrical contacts on the cartridge side to those on the main assembly side.

SUMMARY OF THE INVENTION

The primary object of the present invention is to provide an electrophotographic image forming apparatus and a process cartridge, which better assure that the electrical contacts on the main assembly side of the image forming apparatus are reliably and correctly connected to the electrical contacts on the cartridge side, than an electrophotographic image forming apparatus and a process cartridge in accordance with the prior art.

Another object of the present invention is to provide an electrophotographic image forming apparatus and a process cartridge, which precisely position the electrical contacts on the main assembly side of the image forming apparatus, in terms of the direction parallel to the lengthwise direction of the process cartridge, and the direction intersecting to the lengthwise direction of the process cartridge, before the electrical contacts on the main assembly side come into contact with the electrical contacts on the cartridge side.

Another object of the present invention is to provide an electrophotographic image forming apparatus and a process cartridge, which correctly position the electrical contacts on the main assembly side of the image forming apparatus, in terms of the direction parallel to the lengthwise direction of the process cartridge, before the hinged cover of the main assembly is moved from the open position.

Another object of the present invention is to provide an electrophotographic image forming apparatus and a process cartridge, which are superior to an electrophotographic image forming apparatus in accordance with the prior art and a process cartridge in accordance with the prior art, in terms of the positional accuracy with which the electrical contacts on the main assembly side of the image forming apparatus and the electrical contacts on the cartridge side are placed in contact with each other.

Another object of the present invention is to provide an electrophotographic image forming apparatus and a process cartridge, which are smaller than those in accordance with the prior art.

According to an aspect of the present invention, there is provided a process cartridge detachably mountable to a main assembly of an electrophotographic image forming apparatus. The main assembly includes an opening, an opening and closing cover which is movable between an open position for opening said opening and a close position for closing said opening, and a main assembly electrical contact. The process cartridge comprises an electrophotographic photosensitive drum, process means actable on said electrophotographic photosensitive drum, a memory element for storing information relating to said process cartridge, a cartridge electrical contact electrically connected with said memory element, said cartridge electrical contact being electrically connectable to the main assembly electrical contact when the opening and closing cover is moved from the open position to the close position after said process cartridge is mounted to a cartridge mounting position provided in the main assembly of the apparatus, a first engaging portion for engaging with a main assembly supporting member to position the main assembly supporting member with respect to a longitudinal direction of said process cartridge before the opening and closing cover is moved from the open position when said process cartridge is mounted to the cartridge mounting position through the opening, wherein the main assembly supporting member is movably provided in the main assembly of the apparatus and supports the main assembly electrical contact, and a second engaging portion for engaging with said main assembly supporting member which moves in interrelation with a movement of the opening and closing cover when the opening and closing cover is moved from the open position toward the close position after said process cartridge is mounted to the mounting position and for positioning the main assembly supporting member in a direction crossing the longitudinal direction before the main assembly electrical contact is electrically connected with said cartridge electrical contact.

According to another aspect of the present invention, there is provided an electrophotographic image forming apparatus for forming an image on a recording material, to which a process cartridge is detachably mountable. The apparatus comprises (i) an opening, (ii) an opening and closing cover which is movable between an open position for opening said opening and a close position for closing said opening, (iii) a main assembly electrical contact, (iv) a movable main assembly supporting member supporting said main assembly electrical contact, and (v) a mounting portion for detachably mounting said process cartridge. The process cartridge includes an electrophotographic photosensitive drum, process means actable on said electrophotographic photosensitive drum, a memory element for storing information relating to said process cartridge, a cartridge electrical contact electrically connected with said memory element, said cartridge electrical contact being electrically connectable to said main assembly electrical contact when said opening and closing cover is moved from the open position to the close position after said process cartridge is mounted to a cartridge mounting position provided in said main assembly of said apparatus, a first engaging portion for engaging with a main assembly supporting member to position said main assembly supporting member with respect to a longitudinal direction of said process cartridge before said opening and closing cover is moved from the open position when said process cartridge is mounted to said cartridge mounting position through said opening, wherein said main assembly supporting member is movably provided in said main assembly of said apparatus and supports said main assembly electrical contact, and a second engaging portion for engaging with said main assembly supporting member which moves in interrelation with a movement of said opening and closing cover when said opening and closing cover is moved from the open position toward the close position after said process cartridge is mounted to said mounting position and for positioning said main assembly supporting member in a direction crossing the longitudinal direction before said main assembly electrical contact is electrically connected with said cartridge electrical contact.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention will be described with reference to the appended drawings. The measurements, materials, and shapes of the structural components described in the following embodiments of the present invention, and the positional relationship among the components, are not intended to limit the scope of the present invention, unless specifically noted.

[General Description of Image Forming Apparatus]

Next, the developing apparatus, process cartridge, and image forming apparatus, in the preferred embodiment of the present invention will be described with reference to the drawings.

Figure 1:
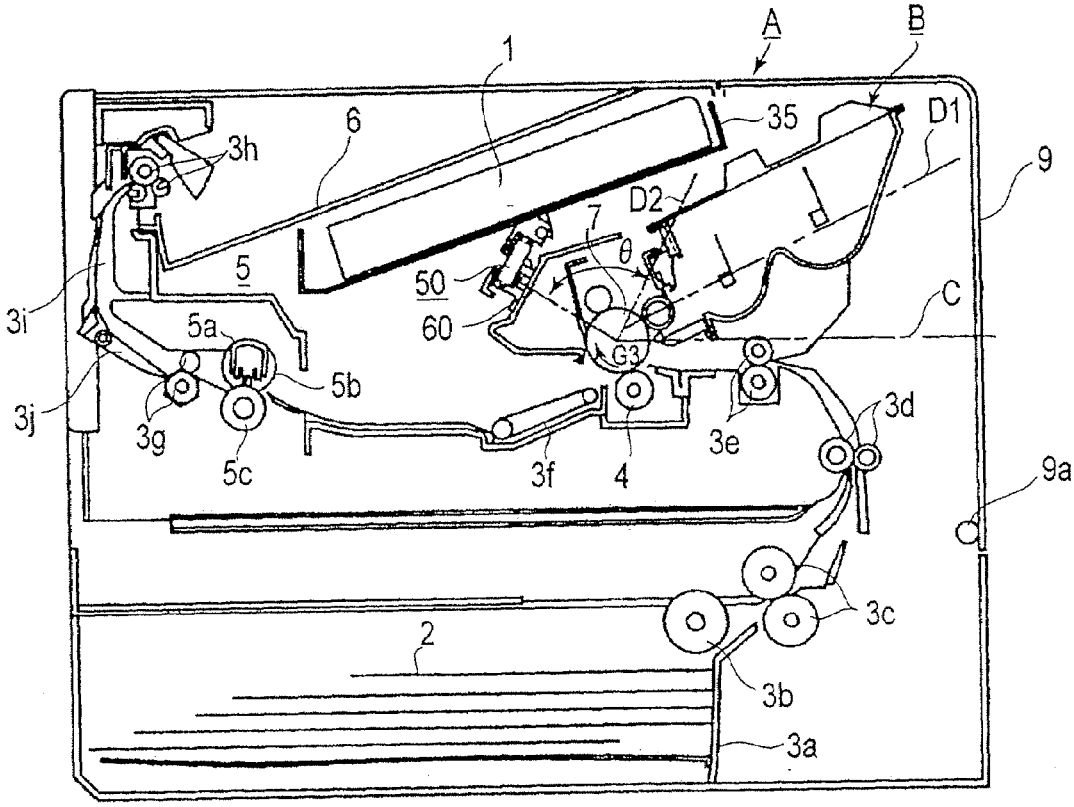
FIG. 1 is a schematic drawing of the image forming apparatus in the preferred embodiment of the present invention, showing the general structure thereof.
Figure 2:
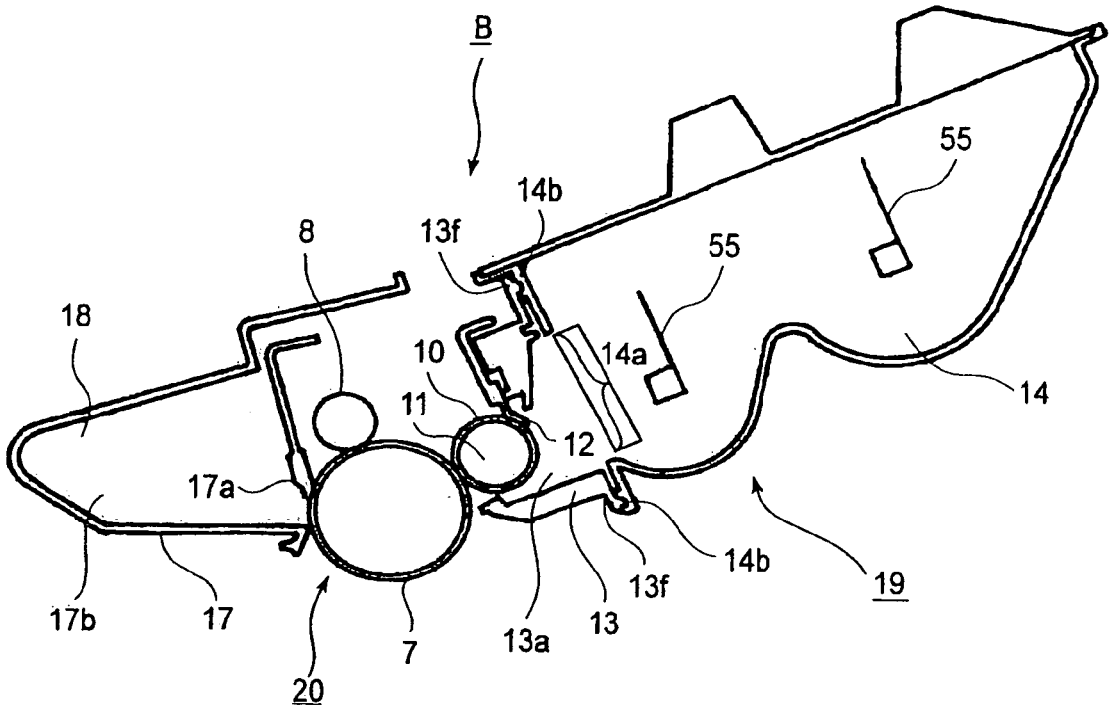
FIG. 2 is a sectional view of the process cartridge in the preferred embodiment of the present invention.

First, referring to FIGS. 1 and 2, the image forming apparatus in which the process cartridge structured in accordance with the present invention is removably mountable will be described. FIG. 1 is a schematic drawing of the image forming apparatus A in the preferred embodiment of the present invention, showing the general structure thereof. FIG. 2 is a sectional view of the cartridge B removably mountable in the image forming apparatus A in the preferred embodiment of the present invention.

Here, an image forming apparatus means an apparatus which forms an image on a recording medium (for example, a recording paper, an OHP sheet, fabric, etc.). It includes, for example, an electrophotographic copying machine, an electrophotographic printer (for example, an LED printer, a laser beam printer, etc.), an electrophotographic facsimile apparatus, an electrophotographic word processor, etc. The following preferred embodiment of the present invention will be described with reference to a laser beam printer as an image forming apparatus which employs one of the electrophotographic image formation processes.

The image forming apparatus A (which in this embodiment is a laser beam printer) has an electrophotographic photosensitive member 7 in the form of a drum (which hereinafter will be referred to as the photosensitive drum 7). The photosensitive drum 7 is charged by a charge roller 8 as a charging means. The charged photosensitive drum 7 is exposed to the beam of laser light projected, while being modulated with image formation data, from an optical apparatus 1 as an optical means having a laser diode, a polygon mirror, a lens, and a deflective mirror. As a result, an electrostatic latent image in accordance with the image formation data is formed on the photosensitive drum 7.

This electrostatic latent image is developed into a visible image, that is, an image formed of toner, by a developing apparatus as a developing means, and developer (which hereinafter will be referred to as toner).

Meanwhile, in synchronism with the formation of the toner image, a recording medium 2 placed in a cassette 3*a* is conveyed from the cassette 3*a* to the transfer station, by a pickup roller 3*b*, and conveyance roller pairs 3*c*, 3*d*, and 3*e*. In the transfer station, a transfer roller 4 as a transferring means is disposed so that the recording medium 2 will be pinched between the transfer roller 4 and the photosensitive drum 7. To the transfer roller 4, voltage is applied to transfer the toner image on the photosensitive drum 7, onto the recording medium 2.

After the transfer of the toner image onto the recording medium 2 in the transfer station, the recording medium 2 is conveyed to a fixing apparatus 5 as a fixing means, by way of a conveyance guide 3*f*.

The fixing apparatus 5 is provided with a drive roller 5*c*, and a fixation roller 5*b* containing a heater 5*a*. While the recording medium 2 is moved through the fixing apparatus 5, the fixation apparatus 5 applies heat and pressure to the recording medium 2 so that the toner image having just been transferred onto the recording medium 2 is fixed to the recording medium 2.

After the fixation, the recording medium 2 is conveyed further by discharge roller pairs 3*g* and 3*h*, and is discharged into a delivery tray 6 through a reversal path 3*i*.

Incidentally, it is possible to activate a pivotable flapper 3*j* in order to discharge the recording medium 2 without moving through the reversal path 3*i*. The pickup roller 3*b*, the conveyance roller pairs 3*c*, 3*d*, and 3*e*, the conveyance guide 3*f*, the discharge roller pairs 3*g* and 3*h*, etc., constitute a means for conveying the recording medium 2.

As for the cartridge B, the photosensitive drum 7 is rotated, and while the photosensitive drum 7 is rotated, its peripheral surface is uniformly charged by the voltage being applied to the charge roller 8 as a charging means. Then, a latent image is formed on the photosensitive drum 7 by projecting a beam of laser light from the optical apparatus 1 while modulating the beam of laser light with image formation data. The thus obtained latent image is developed with the use of the developing apparatus 19 and developer.

To describe in more detail, the charge roller 8 is disposed in contact with the photosensitive drum 7, and charges the photosensitive drum 7. The charge roller 8 is rotated by the rotation of the photosensitive drum 7. The developing apparatus 19 supplies the portion of the peripheral surface of the photosensitive drum 7 in the development station, with toner, developing thereby the latent image having just been formed on the photosensitive drum 7.

As for the developing apparatus 19, it comprises: a developer container 14 (which hereinafter will be referred to as the toner container); a stirring member 55; a development chamber 13*a*; a development roller 10 as a developing means, which contains a magnetic roll 11 (stationary magnet); and a development blade 12. In operation, the toner in the toner container 14 is sent to the development chamber 13*a* by the rotation of the stirring member 55. As the development roller 10 is rotated, a layer of triboelectrically charged toner is formed on the peripheral surface of the development roller 10 by the development blade 12. Then, the toner is transferred from the surface of the toner layer, onto the peripheral surface of the photosensitive drum 7 in the pattern of the latent image; the toner roller 10 develops the latent image into a visible image, or an image formed of toner. The development blade 12 is a means for regulating the amount of toner borne on the peripheral surface of the photosensitive drum 7 while frictionally charging the toner.

The thus formed toner image is transferred onto the recording medium 2 by the transfer roller 4 as a transferring means. After the transfer, the photosensitive drum 7 is cleared by the cleaning apparatus 17, of the toner remaining on the photosensitive drum 7, and then, the cleared portion of the photosensitive drum 7 is used for the following image formation process. The cleaning apparatus 17 has an elastic cleaning blade 17*a*, as a cleaning means, disposed in contact with the photosensitive drum 7. It scrapes down the aforementioned residual toner remaining on the photosensitive drum 7 after the transfer, with the elastic cleaning blade 17*a*, and collects the removed residual toner into a waste toner bin 17*b*.

Figure 3:
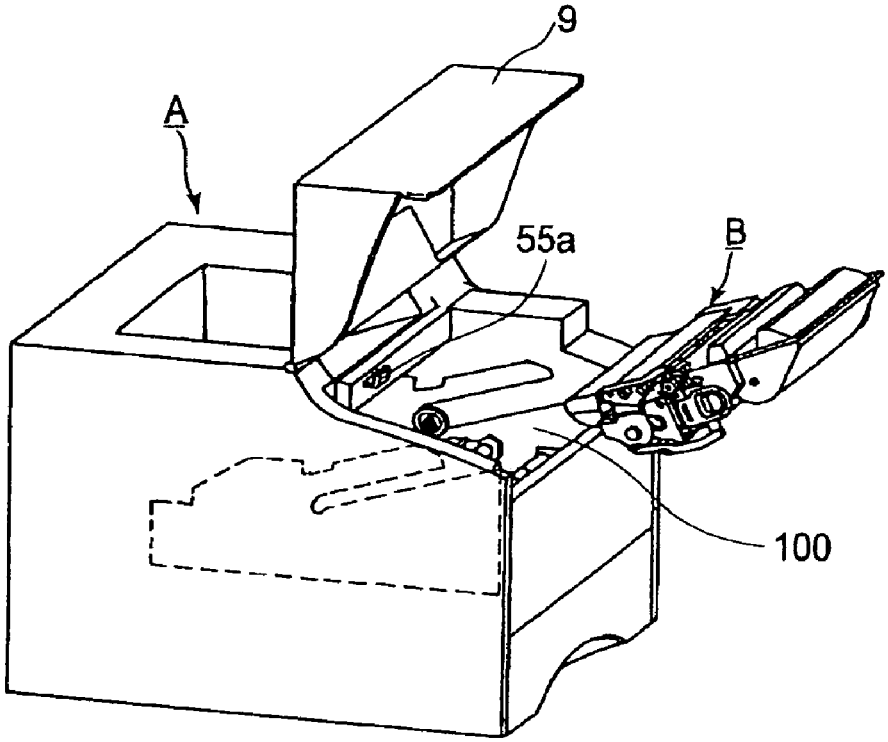
FIG. 3 is an external perspective view of the image forming apparatus, into which the process cartridge is being inserted.

Referring to FIG. 3, as for the mounting or dismounting of the cartridge B, the hinged cover 9, as a cartridge cover (which hereinafter will be referred to as cover 9), with which the image forming apparatus A is provided, is opened to expose the cartridge entrance 100 (open position), and the cartridge B is removably placed by a user, on the cartridge mounting means of the image forming apparatus A, through the cartridge entrance 100; the cartridge B is mounted into, or removed from, the main assembly of the image forming apparatus A through the cartridge entrance 100.

Figure 4:
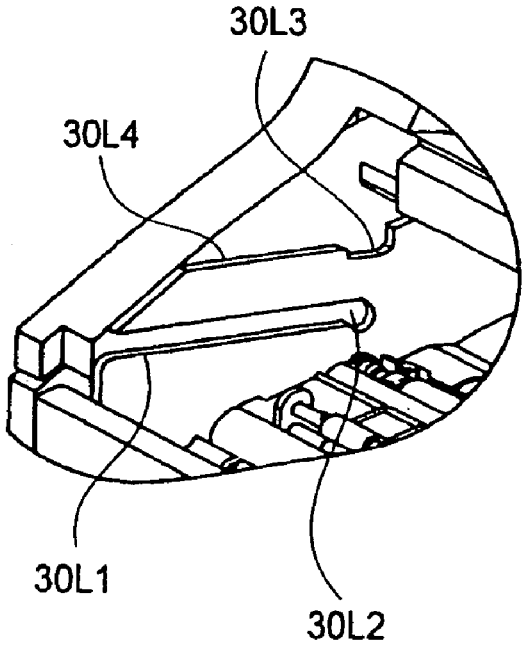
FIG. 4 is a perspective view of the cartridge compartment of the image forming apparatus, in which the process cartridge is mounted.
Figure 5:
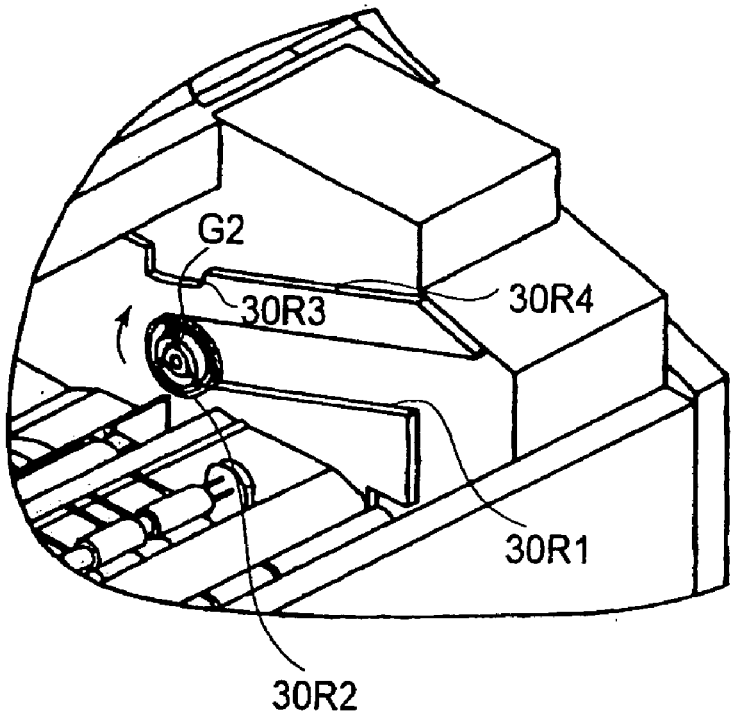
FIG. 5 is a perspective view of the cartridge compartment of the image forming apparatus, in which the process cartridge is mounted.
Figure 6:
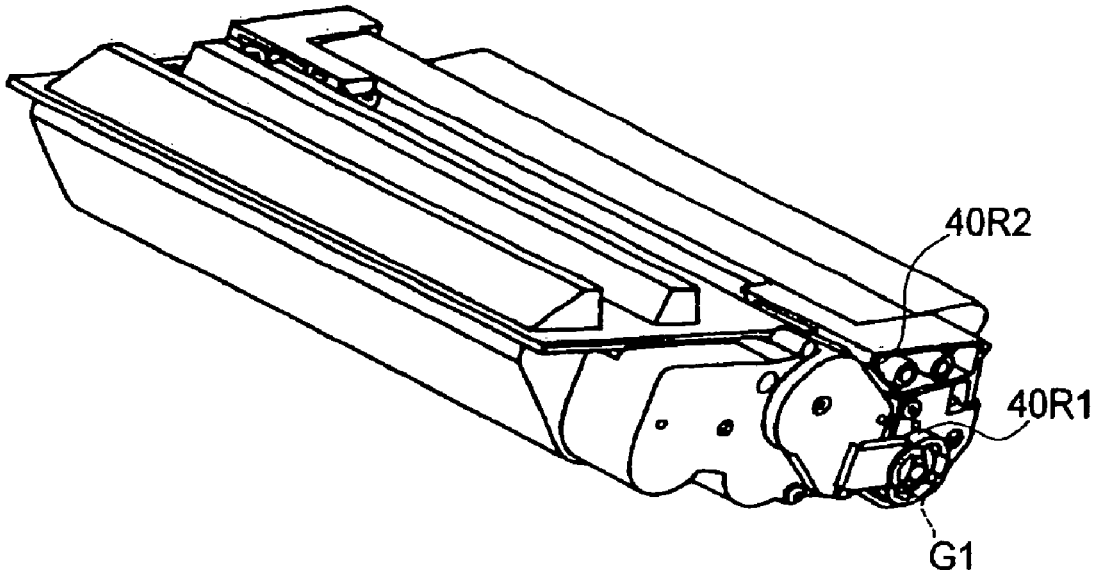
FIG. 6 is an external perspective view of the process cartridge in accordance with the present invention.
Figure 7:
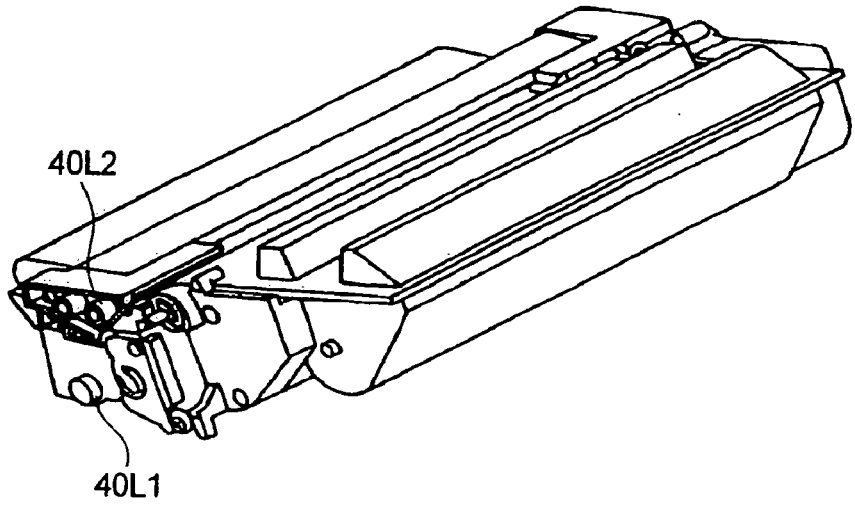
FIG. 7 is an external perspective view of the process cartridge in the preferred embodiment of the present invention.

Referring to FIGS. 4 and 5, the cartridge mounting means is made up of guiding portions 30L1, 30L4, 30R1, and 30R4 of the main assembly of the image forming apparatus A. When mounting the cartridge B into the image forming apparatus A, it is to be inserted into the image forming apparatus A, with the cylindrical portions 40R1 and 40R2 (FIG. 6) of the cartridge B, located at one of the lengthwise ends of the cartridge B, resting on the guiding portions 30R1 and 30R4 of the image forming apparatus A, and the cylindrical portions 40L1 and 40L2 (FIG. 7) of the cartridge B, located at the other lengthwise end of the cartridge B, resting on the guiding portions 30L1 and 30L4 of the image forming apparatus A, respectively. As a result, the cylindrical portions 40R1 and 40R2, and the cylindrical portions 40L1 and 40L2, engage the cartridge positioning portions 30R2, 30R3, 30L2, and 30L3 of the main assembly of the image forming apparatus A, respectively; these cartridge positioning portions 30R2, 30R3, 30L2, and 30L3 of the image forming apparatus A accurately position the cartridge B relative to the main assembly of the image forming apparatus A. Then, the cover 9 is closed to cover the cartridge entrance 100 (closed position), which concludes the mounting of the cartridge B into the image forming apparatus A.

As described above, the cartridge B is mounted into the image forming apparatus A along the guiding portions 30R2, 30R3, 30L2, and 30L3. Next, referring to FIGS. 5 and 6, the cartridge B is provided with a coupling G1 as a driving force transmitting means, which is attached to one of the lengthwise ends of the photosensitive drum 7. As the cartridge B is mounted into the image forming apparatus A, the coupling G1 of the cartridge B engages with a coupling G2, with which the image forming apparatus A is provided Thus, as the coupling G2 rotates thereafter (in direction indicated by arrow mark in FIG. 5), the photosensitive drum 7 is rotated by the rotation of the coupling G2 through the coupling G1 (in direction indicated by arrow G3 in FIG. 1) In other words, the driving force of the image forming apparatus A is transmitted to the cartridge B.

As the abovementioned driving force is transmitted to the cartridge B, the cartridge B is subjected to such force that acts in the direction to rotate the cartridge B in the clockwise direction (direction indicated by arrow mark G3 in FIG. 1), that is, the same direction as the rotational direction of the photosensitive drum 7. Therefore, the cylindrical portion 40R2 (FIG. 6) of the cartridge B is pressed toward the slanted surface 30R3 (FIG. 5) of the image forming apparatus A by this force, and comes into contact therewith. As a result, the position of the cartridge B relative to the image forming apparatus A becomes fixed.

Referring to FIG. 1, as for the track the cartridge B follows as it is mounted into the image forming apparatus A, it is parallel to a line D1, while the cartridge B is following the entrance side of the track, or the upstream side of the track in terms of the cartridge insertion direction (line C represents horizontal direction). More specifically, the angle of the line D1 relative to the horizontal direction C is roughly 20°. Toward the end of the mounting of the cartridge B into the image forming apparatus A, the track of the cartridge B becomes parallel to a line D2, the angle of which relative to the line C indicating the horizontal direction is rough roughly 60. The switching of the mounting direction of the cartridge B from the direction parallel to the line D1 to the direction parallel to the line D2 during the mounting of the cartridge B into the image forming apparatus A can inform a user that the process cartridge B is being accurately mounted into the image forming apparatus A. Although the angle of the entrance side of the track of the cartridge B, parallel to the line D1, and the angle of the deepest end portion of the track of the cartridge B, parallel to the line D2, are roughly 20° and 60°, respectively, relative to the horizontal direction represented by the line C, the angles of the two portions of the track of the cartridge B do not need to be limited to these angles. They may be modified in accordance with the configuration of the recording medium conveyance path of the image forming apparatus A, or the like factors.

[Structure of Process Cartridge Frame]

Next, the structure of the frame of the cartridge B in the preferred embodiment of the present invention will be described.

Referring to FIG. 2, the photosensitive drum 7, the charge roller 8, and the cleaning apparatus 17 having the elastic cleaning blade 17*a*, etc., are attached to the drum supporting frame 18, which is a part of a photosensitive member unit 20.

On the other hand, the developing apparatus unit 19 comprises a toner container 14 for storing toner, and a developing means frame 13 for holding the development roller 10 and the development blade 12. The toner container 14 and the developing means frame 13 are integrated by welding the flange portion 14*b* and flange portion 13*f* to each other by means of welding or the like.

The photosensitive member unit 20 and the developing apparatus unit 19 are connected with a pair of pins 31 (FIG. 8), being enabled to pivot about the pins 31 relative to each other. This is the general structure of the cartridge B.

Figure 8:
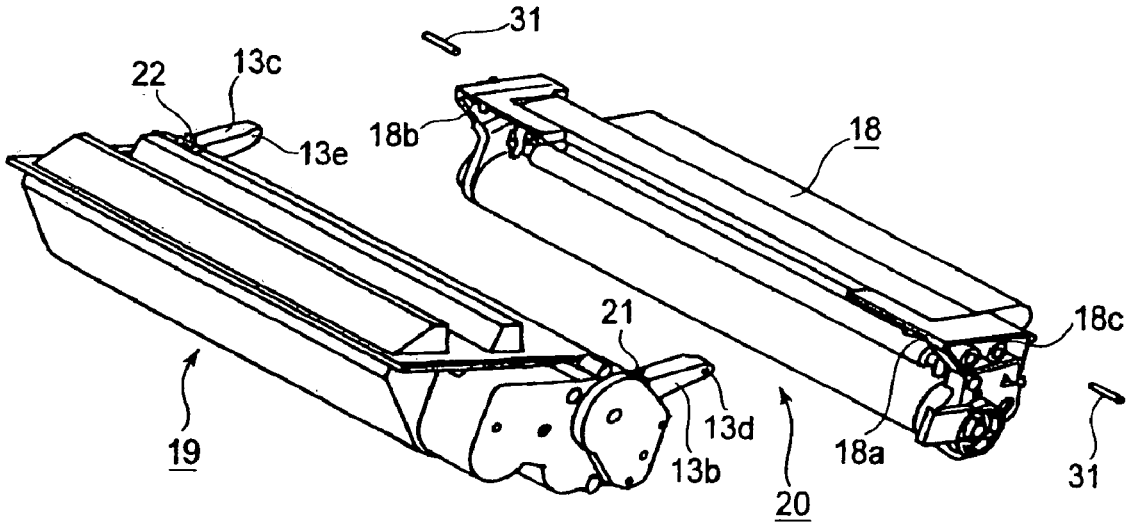
FIG. 8 is an external perspective view of the process cartridge in the preferred embodiment of the present invention, showing the structure thereof.

More specifically, referring to FIG. 8, the developing means frame 13 is provided with a pair of arm portions 13*b* and 13*c*, which are located at the lengthwise (direction parallel to axial line of development roller 10) ends of the frame 13, one for one. The arm portions 13*b* and 13*c* are provided with round holes 13*d* and 13*e*, respectively, the axial lines of which are parallel to the development roller 10.

The drum supporting frame 18 is provided with a pair of recesses 18*a* and 18*b*, which are located at the lengthwise ends of the drum supporting frame 18, one for one, and in which the arm portions 13*b* and 13*c* are inserted, respectively. Thus, the arm portions 13*b* and 13*c* are inserted into the recesses 18*a* and 18*b*, respectively. Then, one of the connective members 31 (pins) is put through the hole 18*c* of the drum supporting frame 18 and the hole 13*d* of the arm portion 13*b*, and then, is pressed into the hole (unshown) of the drum supporting frame 18, which is in the inward wall of the drum supporting frame 18, whereas the other connective member 31 (pin) is put through the hole (unshown) of the drum supporting frame 18 and the hole 13*e* of the arm portion 13*c*, and then, is pressed into the hole (unshown) of the drum supporting frame 18, which is on the opposite side of the frame 18. As a result, the photosensitive member unit 20 and the developing apparatus unit 19 become connected to each other, being enabled to pivot about the axial lines of the connective members 31 relative to each other.

With the photosensitive member unit 20 and the developing apparatus unit 19 being connected to each other, a pair of compression springs 21 and 22 attached to the base portions of the arm portions 13*b* and 13*c* are placed in contact with, being thereby pressed upon, the top walls of the recesses 18*a* and 18*b*, respectively, of the drum supporting frame 18. As a result, the springs 21 and 22 press downward the developing apparatus unit 19, ensuring that the development roller 10 is kept pressed upon the photosensitive drum 7.

(Structure of Storage Means)

Next, referring to FIGS. 2, 9(*a*)–9(*c*), 10(*a*), and 10(*b*), the storage means 60 (information storing means) mounted in the cartridge B will be described.

The storage means 60 is attached to the drum supporting frame 18 of the cartridge B.

Figure 9:
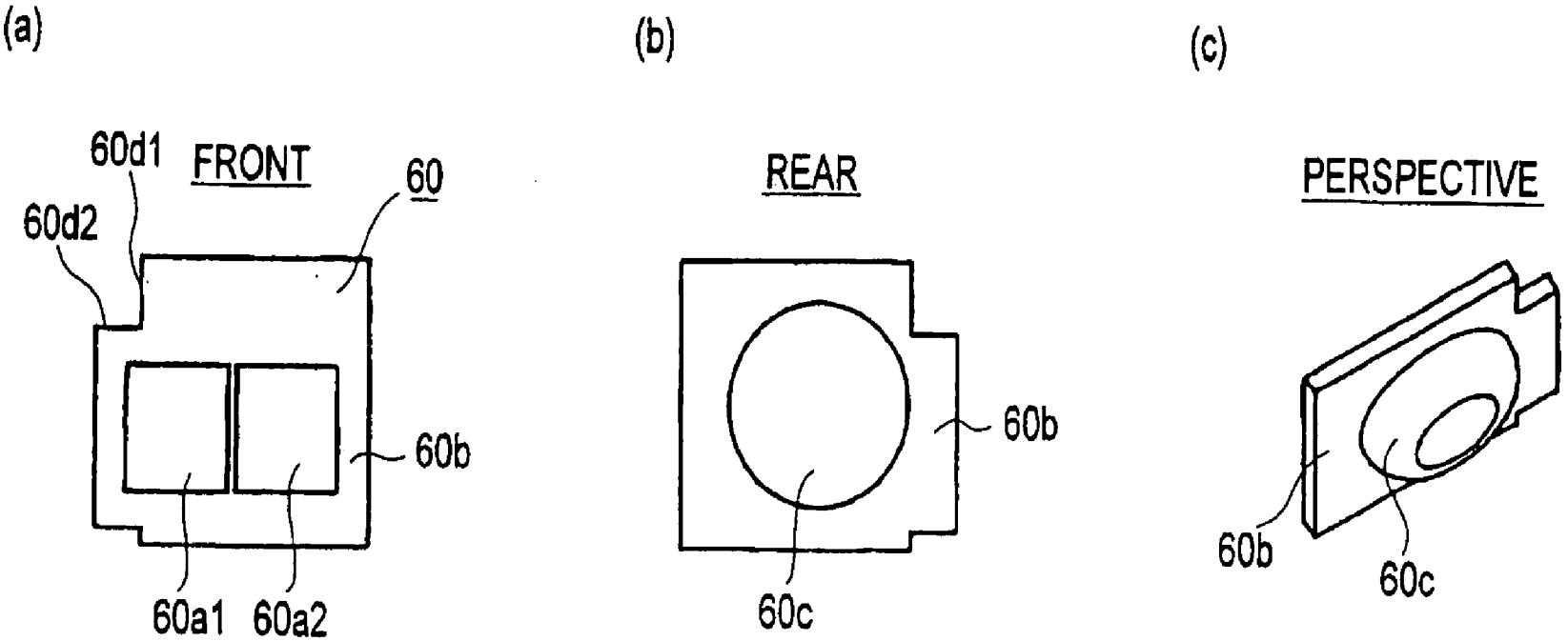
FIGS. 9(*a*)–9(*c*) are drawings for depicting the structure of the storage means in the preferred embodiment of the present invention.

Referring to FIGS. 9(*a*)–9(*c*), the storage means 60 is provided with a substrate 60*b*, and electrical contacts 60*a*1 and 60*a*2 as electrical contacts on the cartridge side attached to one of the primary surfaces of the substrate 60*b*. The storage means 60 is also provided with a storage chip 60*c* as a storage element, such as a RAM, ROM, etc., which are on the opposite surface of the substrate 60 from the electrical contacts 60*a*1 and 60*a*2. FIGS. 9(*a*)–9(*c*) show that the storage chip 60*c* is covered with resin or the like.

The necessary information regarding the cartridge B is stored in advance in this storage chip 60*c*. After the mounting of the cartridge B into the proper position in the image forming apparatus A, information is communicated between the storage chip 60*c* and the main assembly of the image forming apparatus A; such information as the current condition, history, etc., of the cartridge B is reported to a control chip (unshown) of the image forming apparatus A, which displays the condition of the cartridge B to an operator, in addition to controlling the processing means, based on the reported information. The storage chip 60*c* is writable even during the usage of the cartridge B. Therefore, information is written into the storage chip 60*c* any time as necessary. Here, the information regarding the cartridge B means the lot number, initial values for the processing conditions, current condition, usage history, etc., of the process cartridge B, the characteristics of the image forming apparatus A, the characteristics of the processing means, etc.

The abovementioned electrical contacts 60*a*1 and 60*a*2 are electrically connected to the electrical contacts 54 (FIG. 12) of the image forming apparatus A, in order to write information into the storage chip 60*c*. The electrical contacts 60*a*1 and 60*a*2 are two pieces of a plate of phosphor bronze plated with nickel and gold, and are attached to the substrate 60*b*.

Figure 10:
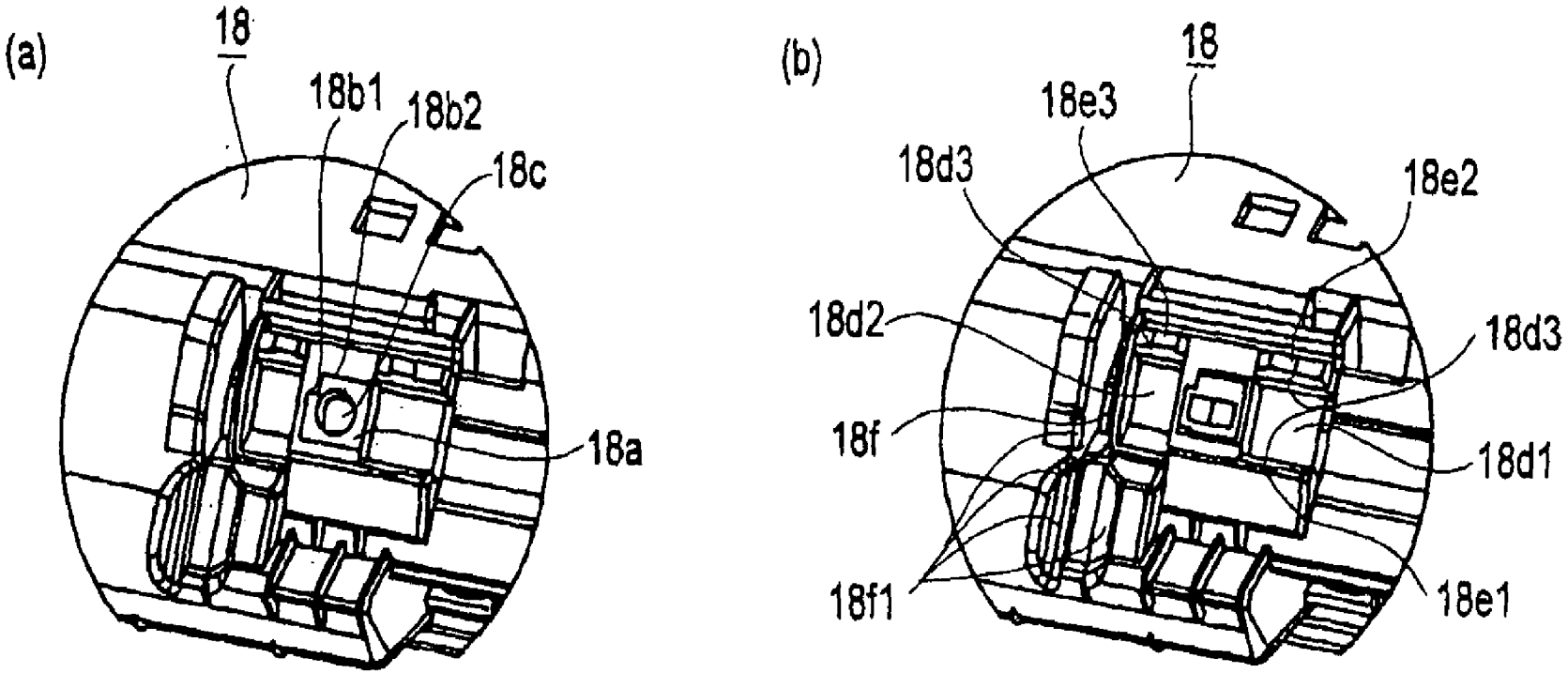
FIGS. 10(*a*) and 10(*b*) are drawings for depicting the storage means attachment portion.

Referring to FIGS. 10(*a*) and 10(*b*), the drum supporting frame 18 of the cartridge B is provided with a chip attachment portion 18*a* to which the storage means 60 is to be attached. FIG. 10(*a*) shows the chip attachment portion 18*a* prior to the attachment of the storage means 60 thereto, and FIG. 10(*b*) shows the chip attachment portion 18*a* and storage means 60 after the attachment of the latter to the former.

As for the method for attaching the storage means 60 to the chip attachment portion 18*a*, an unshown piece of two-sided adhesive tape, adhesive itself, or the like is placed on the substrate 60*b*, in a manner of surrounding the storage chip 60*a* of the storage means 60, and then, the storage means positioning portions 60*d*1 and 60*d*2 of the storage means 60 are placed in contact with the storage means positioning portions 18*b*1 and 18*b*2 of the drum supporting frame 18, accurately positioning thereby the storage means 60 relative to the chip attachment portion 18*a*.

The drum supporting frame 18 has a recess 18*c* for preventing the storage chip 60*c* from interfering with the chip attachment portion 18*a* after the attachment of the storage means 60 to the drum supporting frame 18. The drum supporting frame 18 also has a first contact portion 18*f*, which will be next to the storage means 60 after the attachment of the storage means 60 to the drum supporting frame 18. The first contact portion 18*f* controls the position (in terms of a direction parallel to lengthwise direction of photosensitive drum 7) of the contact portion 52*c* (FIG. 13(*b*)) of the first supporting member 52 (first supporting member on main assembly side) of the movable contact supporting member 50 of the main assembly of the image forming apparatus A, in accordance with the position of the cartridge B, during the insertion of the cartridge B. The first contact portion 18*f* is in the form of a groove, and the corners of the first contact portion 18*f*, on the side from which the supporting member 52 enters the first contact portion 18*f*, have been chamfered, being therefore provided with slanted surfaces 18*f*1, making it easier for the aforementioned contact portion 52*c* to be easily and correctly guided in the predetermined direction.

Figure 13:
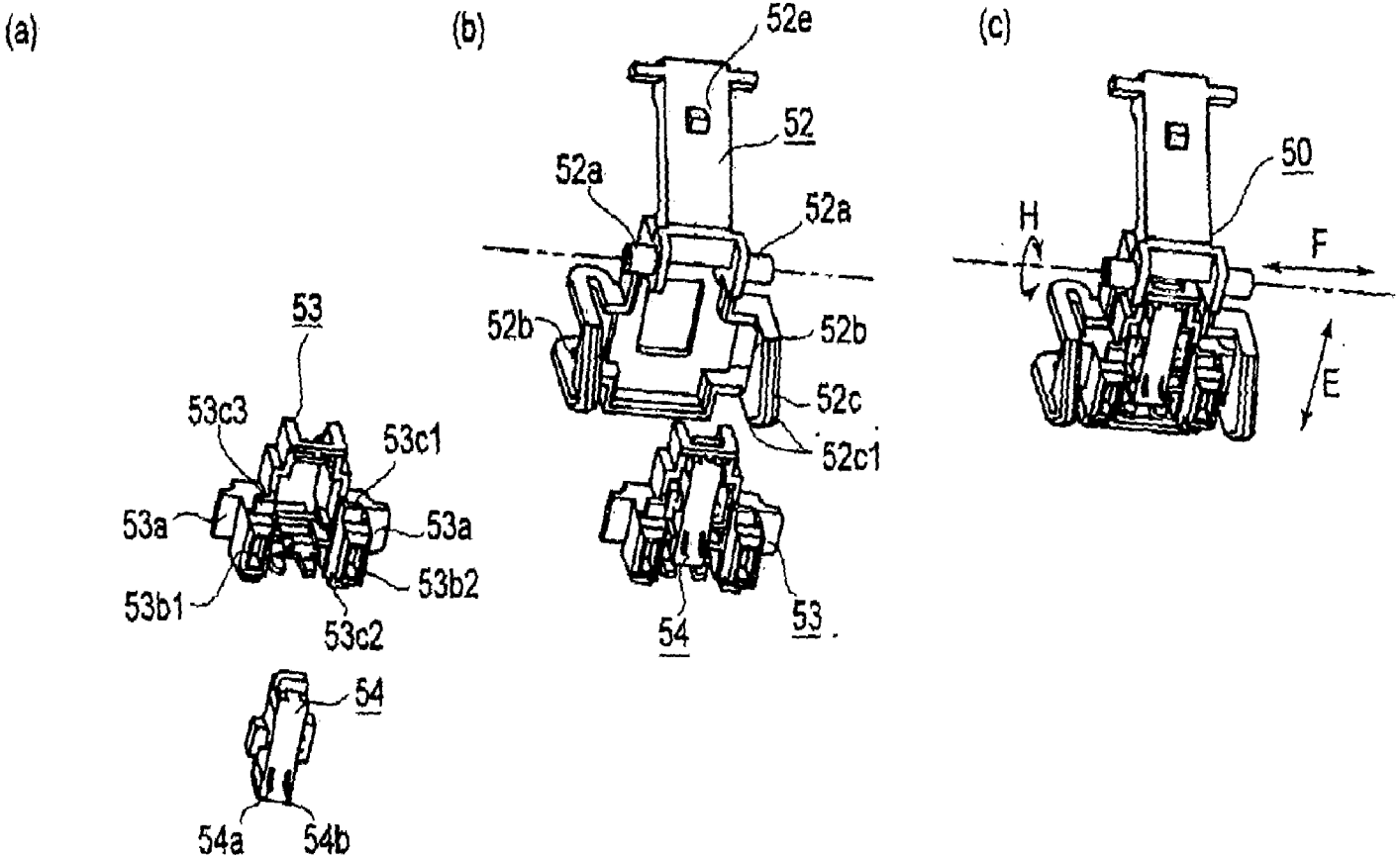
FIGS. 13(*a*)–13(*c*) are perspective drawings for describing the electrical contact on the main assembly side of the image forming apparatus, showing the structures thereof.

The cartridge B has second contact portions 18*d*1 and 18*d*2, which are for controlling the positions of the contact portions 53*b*1 and 53*b*2 of the second supporting member 53 (FIG. 13(*a*)) of the supporting member 50 of the image forming apparatus A (in terms of a direction intersecting a direction, in terms of which the first contact portion 18*f* controls the position of the contact portion 52*c*). The second contact portions 18*d*1 and 18*d*2 also are in the form of a groove. Further, the corners of the second contact portions 18*d*1 and 18*d*2, on the side from which the supporting member 53 (second supporting member on the main assembly side) comes into contact with the second contact portions 18*d*1 and 18*d*2, are chamfered, being therefore provided with slanted surfaces 18*d*3, making it easier for the contact portions 53*b*1 and 53*b*2 of the second supporting member 53 to be guided by the second contact portions 18*d*1 and 18*d*2 in the form of a groove.

The cartridge B is also provided with regulating portions 18*e*1, 18*e*2, and 18*e*3, which control the positions of the contact portions 53*c*2, 53*c*3, and 53*c*1 of the second supporting member 53 (FIG. 13(*a*)) of the supporting member 50 of the image forming apparatus A (in terms of a direction perpendicular to the surfaces of the electrical contacts 60*a*1 and 60*a*2 of the storage means 60).

The functions of the first contact portion 18*f*, the second contact portions 18*d*1 and 18*d*2, and the regulating portions 18*e*1, 18*e*2, and 18*e*3 will be described later in detail.

Figure 15:
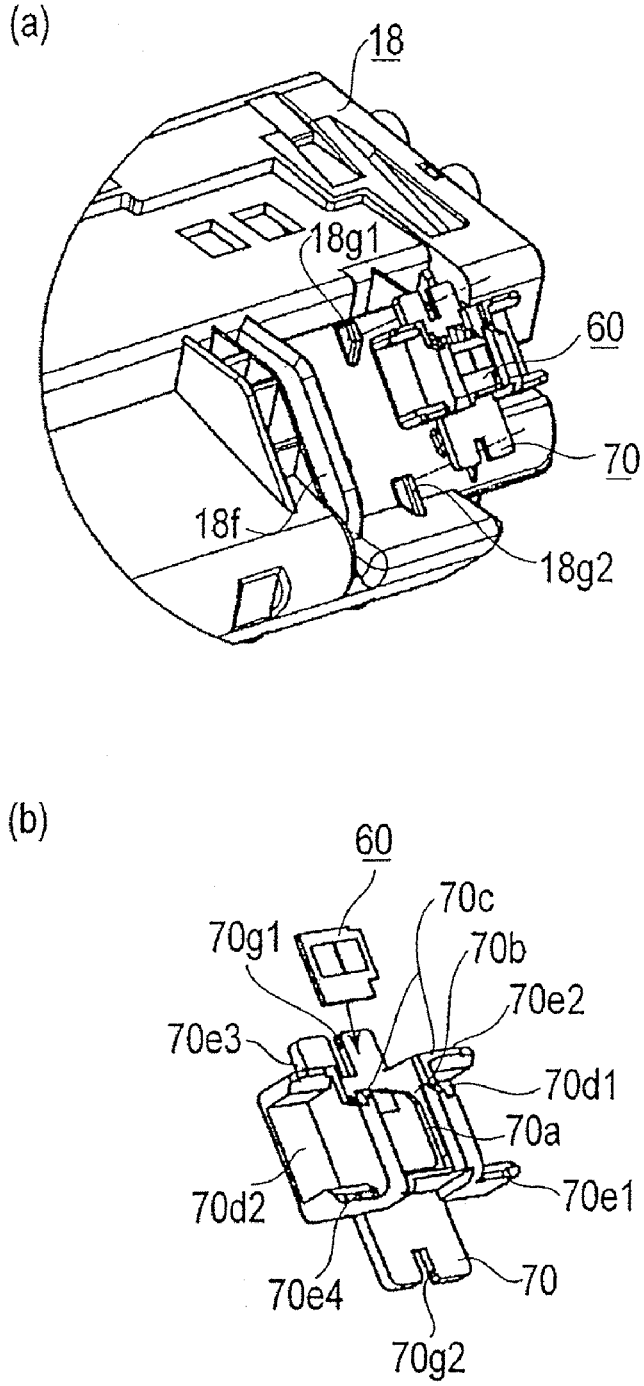
FIGS. 15(*a*) and 15(*b*) are perspective drawings of another example of the process cartridge in the preferred embodiment of the present invention.

In this embodiment, the chip attachment portion 18*a* to which the storage means 60 is to be attached, the first contact portion 18*f*, the second contact portions 18*d*1 and 18*d*2, and the regulating portions 18*e*1, 18*e*2, and 18*e*3 are integral parts of the drum supporting frame 18. Referring to FIGS. 15(*a*) and 15(*b*), however, a chip attachment portion 70*a* to which the storage means 60 is to be attached, second contact portions 70*d*1 and 70*d*2, and regulating portions 70*e*1, 70*e*2, 70*e*3, and 70*e*4 may be formed as integral parts of a storage means holding member 70 (which hereinafter will be referred to as an attachment member 70) independent from the drum supporting frame 18 and to be attached to the drum supporting frame 18. To describe the attachment member 70 in more detail referring to FIGS. 15(*a*) and 15(*b*), the storage means 60 is to be inserted into the attachment member 70, to the attachment portion 70*a*, following the groove 70*b* of the attachment member 70, and then, is fixed to the attachment member 70 by thermally crimping the ribs 70*c*, as shown in FIG. 15(*b*). Further, the contact portions (grooves) 70*g*1 and 70*g*2 of the attachment member 70 are to be engaged with the contact portions (ribs) 18*g*1 and 18*g*2 of the drum supporting frame 18, as shown in FIG. 15(*a*), in order to fix the attachment member 70 to the drum supporting frame 18. Alternatively, the attachment member 70 may be fixed to the drum supporting frame 18 with the use of two-sided adhesive tape, adhesive, or the like.

(Structures of Electrical Contacts on Main Assembly Side of Image Forming Apparatus)

Next, referring to FIGS. 1, 12, and 13(*a*)–13(*c*), the electrical contacts on the main assembly side of the image forming apparatus A will be described regarding the structures of their connective means.

Referring to FIG. 1, the supporting member 50 as a connective means is positioned so that as the cartridge B is mounted into the image forming apparatus A, it opposes the storage means 60.

Figure 12:
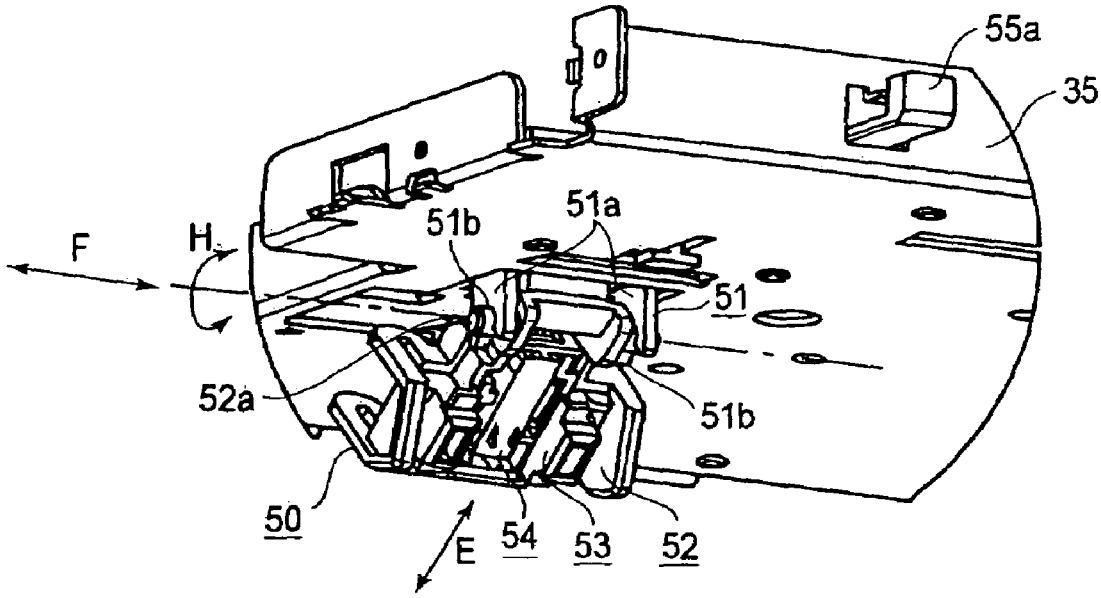
FIG. 12 is a perspective drawing for describing the electrical contacts on the main assembly side of the image forming apparatus, showing the structures thereof.

Referring to FIG. 12, the supporting member 50 has a housing 51, the first supporting member 52, the second supporting member 53, and an electrical connector 54 on the main assembly side of the image forming apparatus A.

The housing 51 is attached to a frame 35 which holds the optical apparatus 1. It has a pair of arm portions 51*a* to which the first supporting member 52 is to attached. Each arm portion 51*a* has a bearing portion 51*b* into which the shaft 52*a*, or rotational axle, of the first supporting member 52 fits.

Referring to FIG. 12, the first supporting member 52 is rotatably attached to the housing 51 so that it can be rotated as indicated by an arrow mark H. More specifically, the pair of arm portions 51*a* are located at the lengthwise ends of the housing 51, one for one, and the first supporting member 52 is positioned between the pair of arm portions 51*a*, with the presence of some play. With the provision of this structural arrangement, the first supporting member 52 is enabled to move relative to the housing 51 in the direction indicated by an arrow mark F in FIG. 12. The direction indicated by the arrow mark F is parallel to the lengthwise direction of the photosensitive drum 7 after the mounting of the cartridge B into the image forming apparatus A.

Referring to FIG. 13(*a*), the electrical connector 54 on the main assembly side has electrical contacts 54*a* and 54*b* on the main assembly side, which are springy members and are electrically connected to the control chip (unshown) through a bundle of wires (unshown) Further, the electrical connector 54 is attached to the second supporting member 53.

The second supporting member 53 is guided by its ribs 53(*a*), by the guiding portions 52*b* (FIG. 13(*b*)) of the first supporting member 52, being thereby enabled to move relative to the housing 51 in the direction indicated by an arrow mark E in FIG. 12 after its attachment to the housing 51. The direction indicated by the arrow mark E is roughly perpendicular (intersecting) to the direction indicated by the arrow mark F. In other words, the direction indicated by the arrow mark E is roughly perpendicular (intersectional) to the direction (lengthwise direction of photosensitive drum 7) in which the first supporting member 52 is enabled to move relative to the housing 51.

With the provision of the above described structural arrangement, the electrical connector 54 on the main assembly side is enabled, by the structure of the supporting member 50, to move in the directions indicated by the arrow marks E, F, and H.

Next, the supporting member 50 which engages the above-described first contact portion 18*f* of the drum supporting frame 18, and the second contact portions 18*d*1 and 18*d*2, of the drum supporting frame 18, will be described regarding its structure.

Referring to FIG. 13(*b*), the first supporting member 52 has the contact portion 52*c* which contacts the above-described first contact portion 18*f*. The edges of the leading end of the contact portion 52*c* are chamfered, being therefore provided with slanted surfaces 52*c*1. Referring to FIG. 13(*a*), the second supporting member 53 is provided with the contact portions 53*b*1 and 53*b*2 which make contact with the second contact portions 18*d*1 and 18*d*2. Referring again to FIG. 13(*a*), the second supporting member 53 has contact portions 53*c*1, 53*c*2, and 53*c*3 which come into contact with the above-described regulating portions 18*e*1, 18*e*2, and 18*e*3 of the cartridge B.

Figure 11:
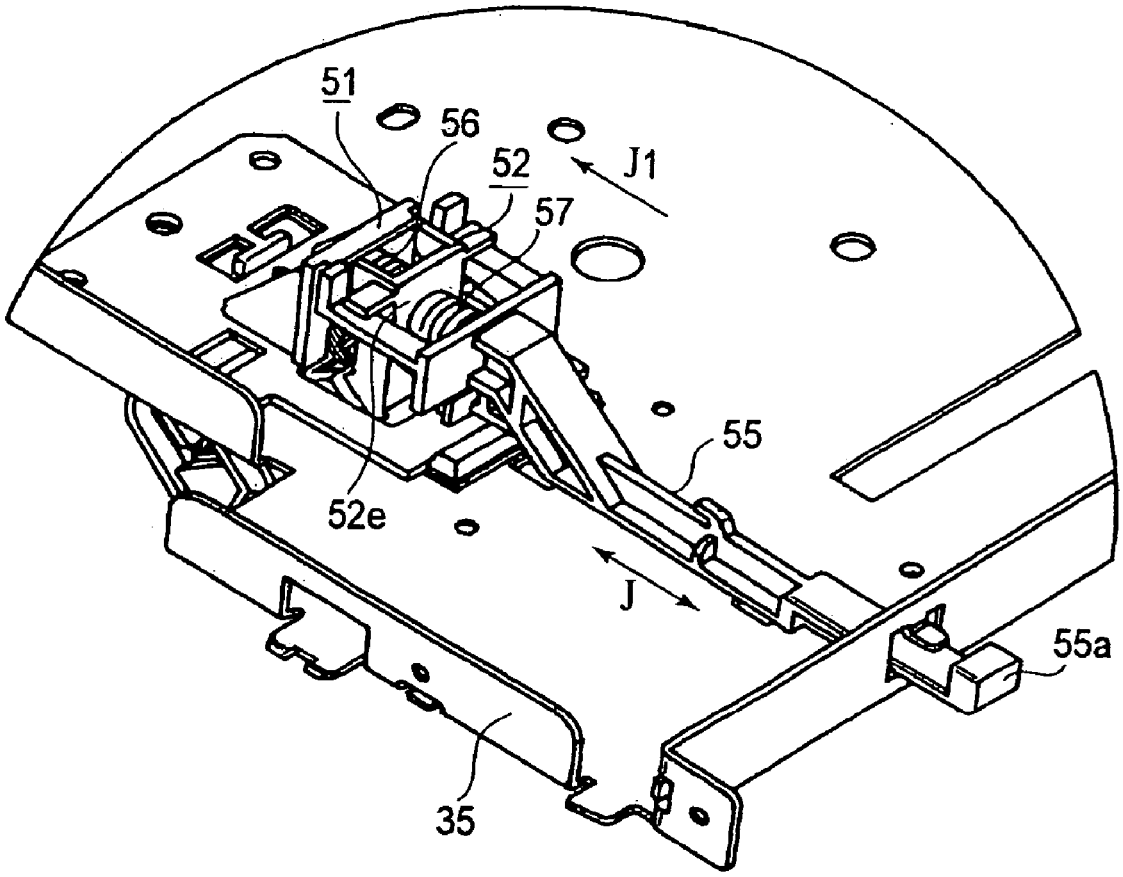
FIG. 11 is a perspective drawing for describing the electrical contacts on the main assembly side of the image forming apparatus in the preferred embodiment of the present invention, showing the structures thereof.

Next, referring to FIGS. 3 and 11, the structure which causes the opening or closing movement of the cover 9 to rotate the supporting member 50 in the arrow H direction will be described.

A user is to close the cartridge cover 9 after the mounting of the cartridge B into the image forming apparatus A. As the cover 9 is closed, the contact portion 55*a*, that is, the end portion of a rod 55, comes into contact with the contact portion (unshown) of the cover 9, and is pressed by the contact portion of the cover 9, causing thereby the rod 55 to retract in the direction indicated by an arrow mark J1. The rod 55 is attached to the frame 35. As the rod 55 is made to retract in the arrow J1 direction, the end portion 52*e* of the first supporting member 52 is pressed in the arrow J1 direction, along with a spring 57 as a pressure generating means. Therefore, the first supporting member 52 rotates about the shaft 52*a* (FIG. 12). The resiliency of the spring 57 is set to a value greater than the value of the sum of the resiliency generated by the electrical contacts 54*a* and 54*b* of the electrical connector 54 on the main assembly side. Therefore, as the rod 55 is pressed, the electrical connector 54 is pressed upon the electrical contacts 60*a*1 and 60*a*2 of the storage means 60, on the predetermined points, while generating a proper amount of contact pressure between the electrical connector 54 and the contacts 60*a*1 and 60*a*2.

On the other hand, as a user opens the cover 9 to remove the cartridge B from the image forming apparatus A, the contact portion (unshown) of the cover 9 is moved away from the contact point 55*a* of the rod 55. As a result, the first supporting member 52 is rotated about the shaft portion 52*a* by the resiliency of a spring 56 as a pressure generating means, pushing back the spring 57 and rod 55. The spring 56 is located between the housing 51 and first supporting member 52.

With the provision of the above-described structural arrangement, the supporting member 50 can be rotated in the arrow H direction by the opening or closing movement of the cover 9.

(Connective Structures of Electrical Contacts on Main Assembly and Cartridge Sides)

Figure 14:
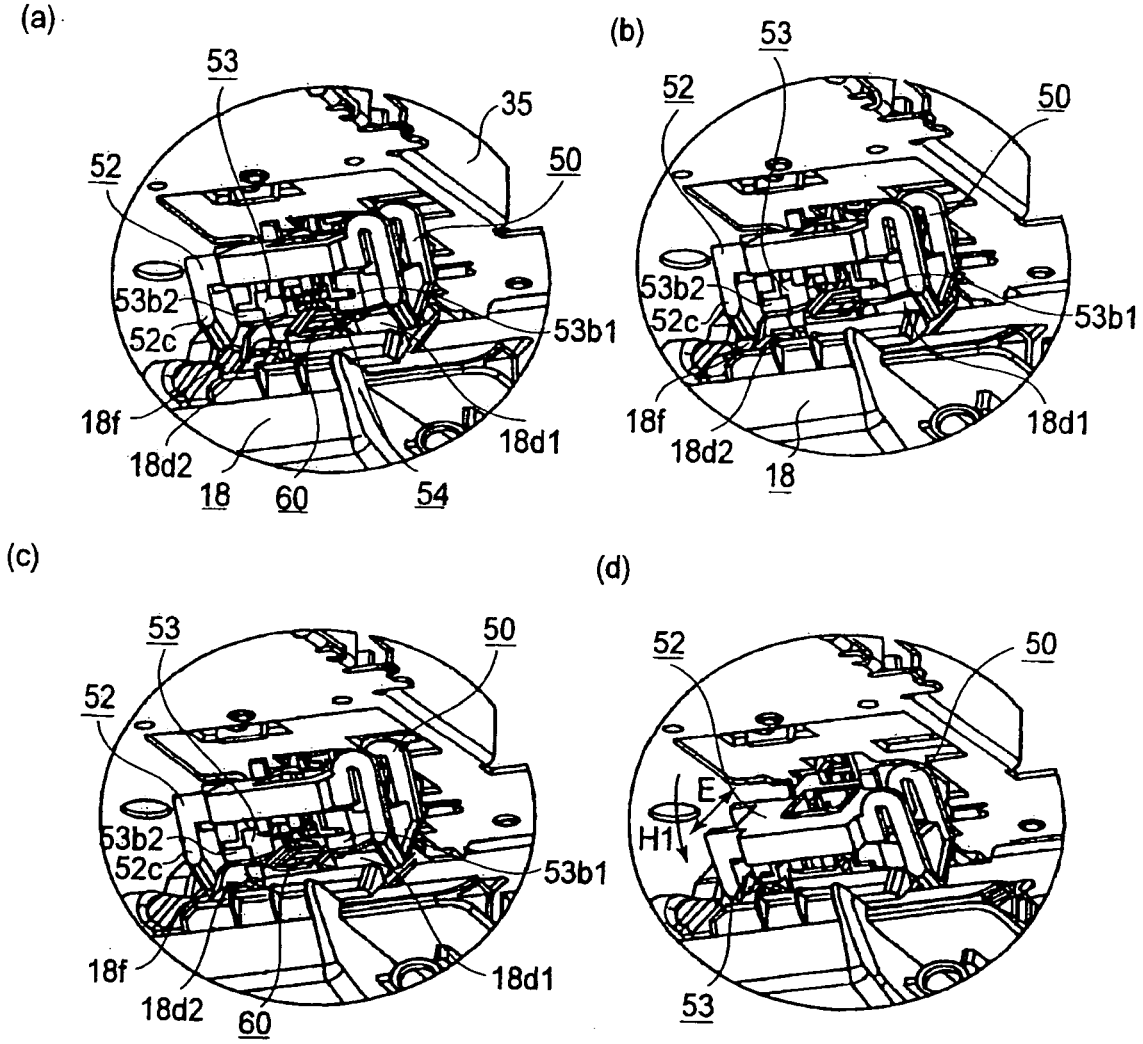
FIGS. 14(*a*)–14(*d*) are perspective drawings for describing how the electrical contacts on the main assembly side become connected to the electrical contacts on the cartridge side, in the preferred embodiment of the present invention.

Referring to FIGS. 1 and 14(*a*)–14(*d*), the structural arrangement for connecting the electrical contacts 54*a* and 54*b* of the electrical connector 54 on the main assembly side, and the electrical contacts 60*a*1 and 60*a*2 on the cartridge B side, will be described.

Referring to FIG. 1, as for the track the cartridge B follows as the cartridge B is mounted into the image forming apparatus A, the portion of the track on the entrance side (line D1), that is, the upstream side in terms of the cartridge insertion direction, forms an angle of roughly 20° relative to the horizontal line C, whereas the portion of the track on the deepest end (line D2) forms an angle of roughly 60° relative to the horizontal line C. FIGS. 14(*a*), 14(*b*), and 14(*c*) sequentially show what occurs as the cartridge B is mounted into the image forming apparatus A.

When the cartridge B is in the state shown in FIG. 14(*a*), the cartridge B is tilted at roughly 60° in terms of its track (D1). In this state, the contact portion 52*c* of first supporting member 52 is yet to engage the first contact portion 18*f* of the drum supporting frame 18, and the contact portions 53*b*1 and 53*b*2 of the second supporting member 53 are also yet to engage the second contact portions 18*d*1 and 18*d*2 of the drum supporting frame 18.

FIG. 14(*b*) shows the state of the connective portions on the cartridge and main assembly sides, in which the cartridge B has been inserted deeper into the image forming apparatus A, compared to the state in FIG. 14(*a*). In this state, the contact portion 52*c* of the first supporting member 52 has just begun to engage the first contact portion 18*f* of the drum supporting frame 18, and the process of accurately positioning the supporting member 50 relative to the drum supporting member 18 in terms of the direction parallel to the lengthwise direction of the photosensitive drum 7 has begun to be carried out.

FIG. 14(*c*) shows the state of the connective portions on the cartridge and main assembly sides, in which the mounting of the cartridge B into the cartridge compartment in the image forming apparatus A by a user has just been completed. In other words, in this embodiment, the cylindrical portions 40R1 and 40R2 have just engaged the guiding portions 30R2 and 30R3, respectively, and the cylindrical portions 40L1 and 40L2 have just engaged into the guiding portions 30L2 and 30L3, respectively. Here, the cylindrical portions 40R1, 40R2, 40L1, and 40L2 belong to the cartridge B, whereas the guiding portions 30R2, 30R3, 30L2 and 30L3 belong to the main assembly of the image forming apparatus A. FIG. 14(*c*) shows the state of the connective portions on the cartridge and main assembly sides, in which the cover 9 is completely open, and the aforementioned contact portion 52*c* is in contact with the aforementioned contact portion 18*f*. Therefore, the supporting member 52 has been accurately positioned relative to the drum supporting frame 18 in terms of the direction parallel to the lengthwise direction of the photosensitive drum 7, and further, the electrical contacts 54*a* and 54*b* on the main assembly side, and the above-described electrical contacts 60*a*1 and 60*a*2 have been fixed in position, in terms of the direction parallel to the lengthwise direction of the photosensitive drum 7 (arrow F direction).

When the connective portions on the cartridge and main assembly sides are in the state shown in FIG. 14(*d*), the cover 9 has been moved by the user to the closed position. As the cover 9 is moved from its open position to its closed position, the supporting member 50 is rotated in the direction indicated by an arrow mark HI, causing thereby the contact portions 53*b*1 and 53*b*2 to come into contact with the contact portion 18*d*1 and 18*d*2, respectively, to accurately position the contact portions 53*b*1 and 53*b*2 in terms of the arrow E direction. After this positioning of the contact portions 53*b*1 and 53*b*2, the electrical contacts 54*a* and 54*b* on the main assembly side become connected to the electrical contacts 60*a*1 and 60*a*2.

As described above, as the cover 9 is closed, the contact point 55*a* of the rod 55 comes into contact with the contact portion (unshown) of the cartridge cover 9, and causes the rod 55 to retract. As the rod 55 is made to retract, the end 52*e* of the first supporting member 52 is pressed in the J1 direction, along with the spring 57. Therefore, the first supporting member 52 is rotated about the shaft portion 52*a* (FIG. 12). The resiliency of the spring 57 is set to a value greater than the value of the sum of the resiliency of the electrical contacts 54*a* and 54*b* on the main assembly side, ensuring that a predetermined amount of contact pressure is always maintained between the electrical contacts 54*a* and 54*b* on the main assembly side and the electrical contacts 60*a*1 and 60*a*2. The contact portions 53*c*1, 53*c*2, and 53*c*3 (FIG. 13(*a*)) are accurately positioned by coming into contact with the regulating portions 18*e*1, 18*e*2, and 18*e*3 (FIG. 10(*b*)) of the cartridge B, ensuring that the predetermined amount of contact pressure is always maintained between the electrical contacts on the cartridge side, and those on the main assembly side.

When removing the cartridge B from the image forming apparatus A, the supporting member 50 is separated from the drum supporting frame 18 following in the reverse order the steps described above.

In this embodiment, the first supporting member 52 engages with the cartridge B during the mounting of the cartridge B into the image forming apparatus A. Further, even after the completion of the mounting of the cartridge B into the image forming apparatus A, the first supporting member 52 remains engaged with the cartridge B, keeping thereby supporting member 50 accurately positioned in terms of the direction parallel to the lengthwise direction of the photosensitive drum 7.

Thereafter, as the user moves the cover 9 from the open position to the closed position, the second supporting member 53 engages with the cartridge B, accurately positioning the electrical contacts (60*a*1 and 60*a*2) on the cartridge side, and the electrical connector 54 of the main assembly side, in terms of a direction roughly perpendicular (intersectional) to the direction in which the first supporting member 52 is movable. The engagement between the second supporting member 53 and cartridge B occurs before the electrical connection is established between the electrical contacts 60*a*1 and 60*a*2 and electrical connector 54 on the main assembly side.

The above-described structural arrangement accurately positions the electrical connector 54 in terms of the direction (arrow F direction) parallel to the lengthwise direction of the photosensitive drum 7. Then, the electrical contacts 54*a* and 54*b* on the main assembly side come into contact with the electrical contacts 60*a*1 and 60*a*2. Thereafter, when the electrical contacts 54*a* and 54*b* on the main assembly side and the electrical contacts 60*a*1 and 60*a*2 slide on (wipe) each other, the electrical contacts 54*a* an 54*b* do not move in the direction parallel to the lengthwise direction of the photosensitive drum 7. Therefore, a predetermined amount of contact pressure is generated between the electrical contacts 54*a* and 54*b* and electrical contacts 60*a*1 and 60*a*2, respectively, in terms of the direction in which the contacts 54*a* and 54*b* elastically flex (direction in which electrical contacts 54*a* and 54*b* press on electrical contacts 60*a*1 and 60*a*2, respectively), ensuring that an electrical connection is always maintained between the electrical contacts (60*a*1 and 60*a*2) on the cartridge side and the electrical connector 54 on the main assembly side.

In this embodiment, the above-described structural arrangement is made to be such that the second supporting member 53 engages with the cartridge B after the engagement of the supporting member 52 with the cartridge B. Therefore, the electrical connector 54 on the main assembly side is connected to the electrical contacts (60*a*1 and 60*a*2) on the cartridge side, after the electrical connector 54 is accurately positioned in terms of a direction roughly perpendicular (intersecting) to the lengthwise direction of the photosensitive drum 7. Therefore, electrical contacts (60*a*1 and 60*a*2) on the cartridge side can be reduced in size, making it possible to reduce the cost of the storage means 60.

Also in this embodiment, the electrical connector 54 on the main assembly side, the contact portion 52*c* of the first supporting member 52, and the contact portions 53*b*1 and 53*b*2 of the second supporting member 53, are positioned so that they align in a direction parallel to the lengthwise direction of the photosensitive drum 7. In addition, the electrical contacts (60*a*1 and 60*a*2) on the cartridge side, the second portions 18*d*1, 18*d*2, and 18*d*3 of the drum supporting frame 18, and the first contact portion 18*f* of the drum supporting frame 18 are positioned so that they align in a direction parallel to the above-mentioned direction parallel to the lengthwise direction of the photosensitive drum 7. Therefore, the supporting member 50 can be reduced in size.

As will be evident from the above given description of the embodiment of the present invention, the cartridge B is provided with the first contact portion 18*f* which accurately positions the supporting member 52, which is the supporting member on the main assembly side of the image forming apparatus A, by coming in contact with the supporting member 52, before the hinged cover 9 is moved from the open position when the cartridge B is mounted into the cartridge compartment of the image forming apparatus A through the cartridge entrance opening 100 of the main assembly. By the supporting member 52, the second supporting member 53, which supports the electrical connector 54, is supported, being thereby enabled to move in the direction intersecting to the aforementioned lengthwise direction. The cartridge B is also provided with the second contact portions 18*d*1 and 18*d*2, which come into contact with the second supporting member 53, as the second supporting member 53 is moved by the movement of the above-mentioned hinged cover 9, which occurs as the cover 9 is moved from its open position to its closed position after the mounting of the cartridge B into the abovementioned cartridge compartment.

With the provision of the above-described structural arrangement, the first supporting member 52 begins to engage the cartridge B while the cartridge B is mounted into the image forming apparatus A. Then, after the completion of the mounting, the supporting member 52 is accurately positioned in terms of the direction parallel to the lengthwise direction of the photosensitive drum 7. Next, as a user moves the cover 9 from its open position to its closed position, the supporting member 50 is rotated by the movement of the cover 9. Then, the first supporting member 52, and the second supporting member 53 movably supported by the first supporting member 52, come into contact with the contact portions 18*d*2 and 18*d*1, respectively, of the cartridge B. As a result, the second supporting member 53 is accurately positioned in terms of the direction roughly perpendicular intersecting the lengthwise direction of the photosensitive drum 7, and then, the electrical connection is established between the electrical connector 54 on the main assembly side and the electrical contacts (60*a*1 and 60*a*2) on the cartridge side.

With the employment of the above-described structural arrangement, it is ensured that the electrical connector 54 rubs the electrical contacts on the cartridge side. Further, as the second supporting member 53 comes into contact with the contact portion 18*d*1 and 18*d*2, it is accurately positioned in terms of the direction roughly perpendicular intersecting the aforementioned lengthwise direction, and thereafter the electrical connector 54 on the main assembly side becomes connected to the electrical contacts (60*a*1 and 60*a*2) on the cartridge side. Therefore, the electrical contacts on the cartridge side can be reduced in size, making it possible to reduce the cost of the storage means 60.

As described above, according to the present invention, it is ensured that the electrical contacts, with which the main assembly of an image forming apparatus is provided, are always placed, and kept, in contact with the electrical contacts, with which a process cartridge removably mountable in the main assembly of the image forming apparatus is provided.

Also according to the present invention, the electrical contacts on the main assembly side of an image forming apparatus are accurately positioned in terms of the direction parallel to the lengthwise direction of a process cartridge, and the direction intersecting the aforementioned lengthwise direction, before the electrical contacts on the main assembly side become electrically connected to the electrical contacts on the cartridge side.

Further, the electrical contacts on the main assembly side and the electrical contacts on the cartridge side are improved in terms of the accuracy of the positions at which they come into contact with the corresponding electrical contacts.

Further, the electrical contacts on the main assembly side and the electrical contacts on the cartridge side can be reduced in size.

Therefore, it is possible to reduce an image forming apparatus and a process cartridge in size.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 272029/2004 and 025000/2005 filed Sep. 17, 2004 and Feb. 1, 2005, which are hereby incorporated by reference.

What is claimed is:

1. A process cartridge detachably mountable to a main assembly of an electrophotographic image forming apparatus, the main assembly including an opening, an opening and closing cover which is movable between an open position for opening the opening and a close position for closing the opening, and a main assembly electrical contact, said process cartridge comprising:

an electrophotographic photosensitive drum;

process means actable on said electrophotographic photosensitive drum;

a memory element configured to store information relating to said process cartridge;

a cartridge electrical contact electrically connected with said memory element, said cartridge electrical contact being electrically connectable to the main assembly electrical contact when the opening and closing cover is moved from the open position to the close position after said process cartridge is mounted to a cartridge mounting position provided in the main assembly of the apparatus;

a first engaging portion configured and positioned to engage a main assembly supporting member to position the main assembly supporting member with respect to a longitudinal direction of said process cartridge before the opening and closing cover is moved from the open position when said process cartridge is mounted to the cartridge mounting position through the opening, wherein the main assembly supporting member is movably provided in the main assembly of the apparatus and supports the main assembly electrical contact; and a second engaging portion configured and positioned to engage the main assembly supporting member which moves in interrelation with a movement of the opening and closing cover when the opening and closing cover is moved from the open position toward the close position after said process cartridge is mounted to the mounting position and to position the main assembly supporting member in a direction crossing the longitudinal direction before the main assembly electrical contact is electrically connected with said cartridge electrical contact.

2. A process cartridge according to claim 1, wherein said first engaging portion, said cartridge electrical contact, and said second engaging portion are arranged in a line extending in the longitudinal direction.

3. A process cartridge according to claim 1, wherein said cartridge electrical contact and said memory element are disposed on a substrate, and said memory element is disposed on a side of said process cartridge opposite from a side on which said cartridge electrical contact is provided.

4. A process cartridge according to claim 1, wherein said cartridge electrical contact has a first cartridge electrical contact and a second cartridge electrical contact, and said first cartridge electrical contact and said second cartridge electrical contact are arranged in a line extending in the longitudinal direction.

5. An electrophotographic image forming apparatus for forming an image on a recording material, to which a process cartridge is detachably mountable, said apparatus comprising:

(i) an opening;

(ii) an opening and closing cover which is movable between an open position for opening said opening and a close position for closing said opening;

(iii) a main assembly electrical contact;

(iv) a movable main assembly supporting member supporting said main assembly electrical contact; and (v) a mounting portion configured and positioned to detachably mount the process cartridge, the process cartridge including, an electrophotographic photosensitive drum; process means actable on the electrophotographic photosensitive drum; a memory element configured to store information relating to the process cartridge; a cartridge electrical contact electrically connected with the memory element, the cartridge electrical contact being electrically connectable to said main assembly electrical contact when said opening and closing cover is moved from the open position to the close position after the process cartridge is mounted to a cartridge mounting position provided in said main assembly of said apparatus; a first engaging portion configured and positioned to engage a main assembly supporting member to position said main assembly supporting member with respect to a longitudinal direction of the process cartridge before said opening and closing cover is moved from the open position when the process cartridge is mounted to said cartridge mounting position through said opening, wherein said main assembly supporting member is movably provided in said main assembly of said apparatus and supports said main assembly electrical contact; and a second engaging portion configured and positioned to engage said main assembly supporting member which moves in interrelation with a movement of said opening and closing cover when said opening and closing cover is moved from the open position toward the close position after the process cartridge is mounted to said mounting position and to position said main assembly supporting member in a direction crossing the longitudinal direction before said main assembly electrical contact is electrically connected with the cartridge electrical contact.

6. An apparatus according to claim 5, wherein said main assembly supporting member has a first main assembly engaging portion engageable with the first engaging portion and a second main assembly engaging portion engageable with the second engaging portion.

7. An apparatus according to claim 6, wherein said first main assembly engaging portion, said second main assembly engaging portion and said main assembly electrical contact are arranged in a line extending in the longitudinal direction.

8. An apparatus according to claim 5, wherein said main assembly supporting member includes a first main assembly supporting member which is movable and a second main assembly supporting member which is movably mounted on said first main assembly supporting member and which supports said main assembly electrical contact.

9. An apparatus according to claim 8, wherein said first main assembly supporting member has a first main assembly engaging portion engageable with the first engaging portion, and said second main assembly supporting member has a second main assembly engaging portion engageable with the second engaging portion.

10. An apparatus according to claim 5, wherein said main assembly electrical contact includes a first main assembly electrical contact and a second main assembly electrical contact, and wherein said first main assembly electrical contact and said second main assembly electrical contact are arranged in a line extending in the longitudinal direction.

11. An apparatus according to claim 5, further comprising an urging member configured and positioned to urge said main assembly supporting member in a direction in which said main assembly electrical contact and the cartridge electrical contact are moved away from each other.

12. An apparatus according to claim 5, further comprising an urging member configured and positioned to urge said main assembly supporting member in a direction in which said main assembly electrical contact and the cartridge electrical contact are contacted to each other, when said opening and closing cover is moved from the open position to the close position.

* * * * *

UNITED STATES PATENT AND TRADEMARK OFFICE

CERTIFICATE OF CORRECTION

PATENT NO. : 7,194,220 B2
APPLICATION NO. : 11/048755
DATED : March 20, 2007
INVENTOR(S) : Teruhiko Sasaki et al.

It is certified that error appears in the above-identified patent and that said Letters Patent is hereby corrected as shown below:

ON THE COVER PAGE:
Item "(54) TITLE" section, "CONTACT AND" should read --CONTACT, AND--.

COLUMN 1:
Line 5, "CONTACT" should read --CONTACT,--.
Line 24, "etc.)" should read --etc.),--.

COLUMN 2:
Line 36, "to" should be deleted.

COLUMN 7:
Line 57, "rough," should be deleted.

COLUMN 11:
Line 13, "to" should be deleted.
Line 34, "(unshown)" should read --(unshown).--.
Line 48, "above described" should read --above-described--.

COLUMN 13:
Line 19, "into" should be deleted.

COLUMN 17:
Line 34, "including," should read --including--.

Signed and Sealed this

Twenty-seventh Day of January, 2009

JOHN DOLL
*Acting Director of the United States Patent and Trademark Office*